United States Patent [19]

Nathan

[11] Patent Number: 4,505,395

[45] Date of Patent: Mar. 19, 1985

[54] MAGAZINE DISPLAY TRAY

[75] Inventor: Walter Nathan, Glencoe, Ill.

[73] Assignee: RTC Industries, Inc., Chicago, Ill.

[21] Appl. No.: 518,382

[22] Filed: Jul. 29, 1983

[51] Int. Cl.[3] ..... A47F 3/14

[52] U.S. Cl. ..... 211/126; 211/10; 211/13; 211/50; 220/23.4; 206/504; 40/324; 40/1; 403/292

[58] Field of Search ..... 211/126, 13, 10, 11, 211/50, 52; 220/23.4; 206/504, 555, 821; D19/92; 40/324, 308; 403/297, 298, 292, 289

[56] References Cited

U.S. PATENT DOCUMENTS

| | | | |
|---|---|---|---|
| D. 144,450 | 4/1946 | Cohen | D19/92 |
| D. 179,276 | 11/1956 | Abrahamson | D19/92 |
| D. 179,534 | 1/1957 | Bullock et al. | D19/92 |
| D. 232,934 | 9/1974 | Perry | D19/92 |
| D. 243,524 | 3/1977 | Intini | D19/92 X |
| 1,750,324 | 3/1930 | Metz | 40/324 |
| 2,069,957 | 2/1937 | Klein | 40/324 |
| 2,100,720 | 11/1937 | Page | 211/50 X |
| 2,132,058 | 10/1938 | Tofte | 40/324 X |
| 3,857,482 | 12/1974 | Shelton | 220/23.4 X |
| 4,069,941 | 1/1978 | Popplewell, Jr. et al. | 220/23.4 |

*Primary Examiner*—J. Franklin Foss
*Assistant Examiner*—Blair Johnson
*Attorney, Agent, or Firm*—Norman Lettvin

[57] ABSTRACT

A unitary, molded, vending and article display tray, for flat articles such as magazines provides a substantially horizontal tray means for receiving, supporting, and holding, in a somewhat confined manner, but providing easy customer manual access to, a plurality of such articles. The head end of the display tray is provided with an upright retaining wall for the tray that has integrally formed therewith a pair of laterally spaced clip segments that operate to hold an exemplar of the tray-held articles at an upright display attitude. The support base for the tray-held articles is elevated above a support surface for the tray by a support flange means that positions the head end of the tray at a slightly elevated attitude, and the support flange means is provided with slots below the article-support base member of the tray that permits laterally ganging together of two or more trays by means of molded clips that are separate from the tray but cooperate with attachment flatures provided as part of the integral display tray.

7 Claims, 5 Drawing Figures

FIG. 3
FIG. 4
FIG. 1
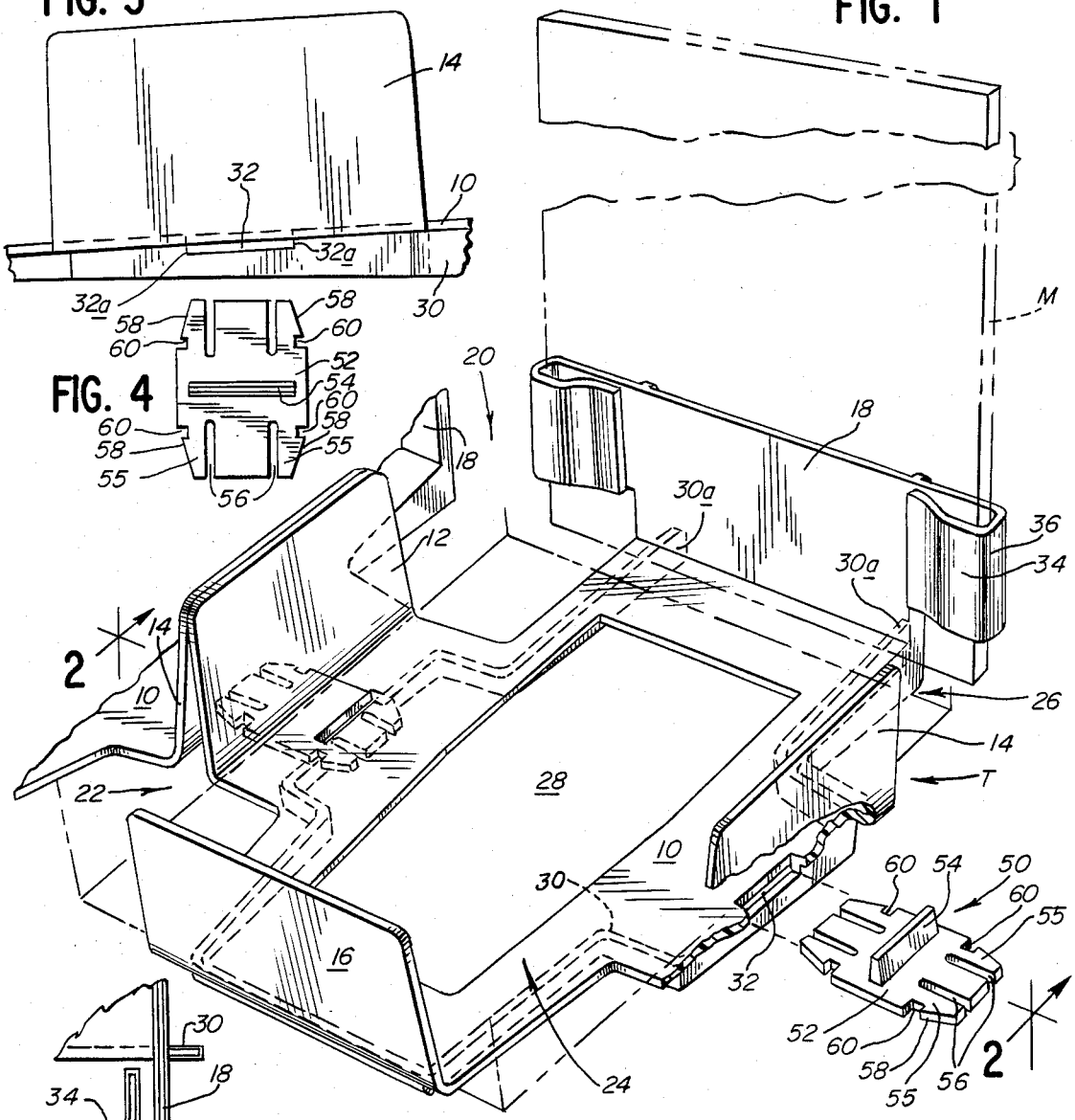
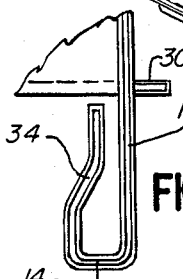
FIG. 5
FIG. 2
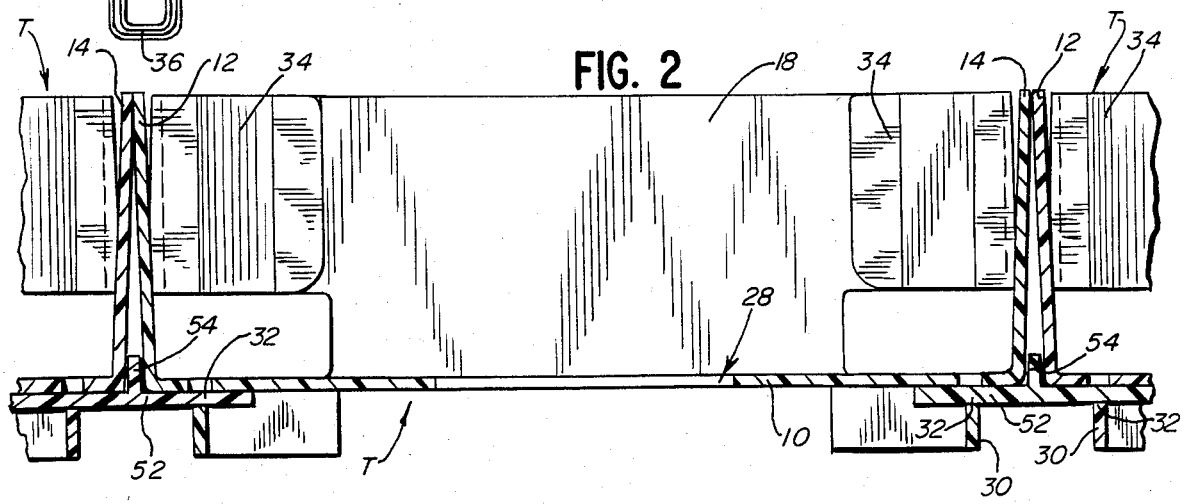

MAGAZINE DISPLAY TRAY

FIELD OF THE INVENTION

This invention relates to an improvement in vending and article display trays, and more particularly to a display tray for flat articles, such as magazines and the like.

BACKGROUND OF THE INVENTION

The orderly display of magazines in stacks on counters is made difficult if the magazine has a slick cover and is quite thick at the magazine's spine and bulges between the lateral edges, because the magazines, under the conditions noted and when stacked, tend to slide on each other, and maintaining the magazines in an orderly, arranged stack becomes quite difficult.

The depositing of a stack of magazines in a rectangular bin that encloses the four edges and corners of the periphery of the magazine stack in undesirable, as the bin tends to hide the magazine from a proper display that would attract the attention of prospective purchasers, and it also becomes difficult to extricate lower units of the stack of magazines from such a bin.

BRIEF SUMMARY OF THE INVENTION

It is one object of this invention to provide an attractive display tray for magazines and the like, which provides both for storage of a supply of magazines in a stack, while at the same time holding an exemplar of the magazine in an upright, exposed, position to attract attention of prospective purchasers.

Another object of this invention is to provide a unitary molded tray, both for holding a plurality of magazines, arranged horizontally, in a vertical stack, while displaying an exemplar of the magazine in an upright display position, and with means for ganging together pairs of trays for increased storage and for multiple advertising display.

Further objects and advantages of this invention will become known to those skilled in the art as these specifications proceed with the description of a preferred form of my invention as shown in the accompanying drawing.

DESCRIPTION OF THE DRAWING

FIG. 1 is a perspective and partially exploded view, with portions broken away, showing my improved magazine display tray, and illustrating how the display tray holds an exemplar of the magazine at the head-end of the tray at an upright attitude, and how adjacent display trays may be ganged together;

FIG. 2 is a cross-sections view taken substantially on line 2—2 of FIG. 1, showing one tray in full, interconnected, or ganged, to two adjacent, identical, magazine holding trays that are each shown in fragmentary view;

FIG. 3 is a fragmentary side elevational view of one side of the tray shown in FIG. 1, particularly showing the slot through which the tray may be ganged, or attached, to an adjacent tray by use of a molded connector bracket shown in FIGS. 1, 2 and 4.

FIG. 4 is a top plan view of the connector for ganging together adjacent trays in the manner shown in FIG. 2; and FIG. 5 is a top fragmentary plan view of the integrally molded edge grip on the tray that is constructed and positioned for gripping an edge of the upright display magazine specimen that is illustrated in broken lines in FIG. 1.

DETAILED DESCRIPTION OF THE INVENTION

Referring now to FIG. 1, the display tray of this application is indicated generally by T, and is in the form of a unitary molded body that provides a generally planar, substantially horizontal but slightly inclined, polygonal, bottom support base 10 upon which a vertical stack of generally flat articles, such as rectangular magazines, may be supported. The magazines in the vertical stack are prevented from substantial sliding, lengthwise or sidewise, by the provision of sidewall restraints 12 and 14, and upright toe-end and head-end restraints, respectively 16 and 18, that are molded integrally with the support base 10 and which extend upwardly, slightly inclined outwardly, of said support base 10. In order to avoid sharp corners, wherein stresses would be developed, the four upright restraints are not precisely perpendicular to the bottom support 10, as can be clearly seen in FIG. 2. Nor do the adjacent upright restraints join in pairs at a right angle corner or junction, but instead, rather gaseous spacings are provided adjacent the projected corner region junctions of said upright restraints, thereby providing large open corners of the tray such as at 20, 22, 24 and 26, through which a corner of each magazine, in the stack on the bottom support 10, may be grasped to afford easy removal of the uppermost magazine copy from the stack of magazines.

The support base 10 has a large generally rectangular polygonal central opening 28 therein, which provides both a saving of plastic material used in forming tray T, and permits some downward settling of the center of the stack of magazines, which is desirable to the extent that the upper surface of the top of the magazine stack does not tend to rise too high.

Surrounding the central opening 28 and integral with the underside of support base 10 is a sinuous U-shaped tray support flange 30, of generally sinuous U-shape, as seen partially in phantom in FIG. 1, and of wedge shaped height, elevation, or rise, as best seen in FIG. 3, which inclines or pitches the stack of magazines on base 10 slightly toward the toe-end restraint 16.

The wedge shape of support 30, as seen in FIG. 3, tends to insure that the stack of magazines will tend to slide in a direction to abut the toe restraint 16. The length of bottom support 10 between end restraints 16 and 18 is selected so that with a stack of magazines supported thereon, there is still room for receiving thereagainst the thickness of an exemplar magazine that is mounted upright, as illustrated in broken lines in FIG. 1.

The sinuous U-shape of support 30 provides that the bight of the U-support 30 will be adjacent toe restraint 16, and that lateral outward bulges in the legs of the U-support will be located adjacent the two side wall restraints 12 and 14, thereby rigidifying the construction in those three areas. As seen in FIGS. 1, 2 and 3, the lateral bulges in the legs of the U are each provided with an elongated attachment aperture 32 therethrough, located immediately below the undersurface of bottom support 10. The free ends 30*a* of the U-support 30 extend laterally beyond the upright plane in which the head-end restraint 18 is located, and the U-support 30 being integrally molded to the bottom support there-at provides support and rigidification of the bottom support 10 and the head-end restraint 18.

The head-end wall, or restraint, 18 of tray T is of a greater lateral extent than the width of a magazine, M, shown in phantom in FIG. 1 by broken lines. Portions of the lateral ends of the head-end restraint 18 are retroverted, or turned inwardly, to provide an elongated channel-like clip segment 34 that overlies a portion of head restraint 18 in spaced relation thereto, with each clip having an enlarged bight 36 that joins a clip segment 34 to one lateral end of the head-end wall 18. The two oppositely facing clip means 34–36 are of a size and location to grip opposite edges of a magazine M therebetween to provide a visual display of the goods. As seen in FIG. 5, the bight 36 is selected to be large enough to accommodate the spine and edge thickness of a magazine between clip segment 34 and head-end wall 18, with the extended, or cantilevered, end 34 of clip segment, serving as a resilient pressure holder that normally lies closer to wall 18, but is resilient enought to permit entry of a magazine M, between clip segment 34 and head-end wall 18, so as to resiliently hold the magazine in the upright display position illustrated in phantom in FIG. 1.

The means of ganging together a pair of adjacent trays T is illustrated in FIGS. 1, 2 and 4, and includes a molded, attachment, spring clip 50 that is shaped to provide a planar main section 52 and a transverse, upstanding, separator flange 54 located midway between the ends of planar section 52. The respective ends of planar section 52 located on opposite sides of flange 54, and includes a pair of elongated, snap-on, resilient jaws 55, whose extended ends are cantilevered free of adjacent sections by reason of the presence of edge slots 56, with the exterior edges of jaws 55 being ramped, or inclined, at 58 to provide for camming against a lateral edge 32*a* of aperture 32, and with a notch 60 for interlock onto and with the thickness of the support wall 30.

The molded spring clip 50, with its opposite lateral ends being snap-connected into aligned slots 32 of a pair of trays T, appear in assembly with the trays T as shown in FIG. 2, with the central upstanding separator flange 54 projecting upwardly and being of a size and location to fit between the lower portions of a pair of adjacent side walls 12 and 14 on two different trays T. This arrangement insures alignment of the clip 50 with the slots 32 to which the ends of the clip 50 are to connect. By pressing together the extended ends of a pair of jaws 55, the clip 50 may be released from its snap-on engagement with the support wall 30 of a tray T, when disassembly is desired.

While I have disclosed herein an improved, unitary, integrally molded, magazine display tray, persons skilled in that art will appreciate that the invention herein may be adapted and modified for related purposes, and it is intended to cover all aspects of my invention herein, as limited solely by the claims appended thereto.

What is claimed and desired to be secured by Letters Patent of the United States is:

1. A vending and article display tray for flat articles, such as magazines, comprising, in combination:

means providing a substantially flat, polygonal, support base for receiving and supporting a plurality of flat articles stacked thereon;

a plurality of restraining wall means extending upwardly of the support base and adapted for general aligning cooperation with portions of the edges of the articles stacked on the base of the tray, but being spaced apart, along the periphery of the support base, to provide open corners for manual access to edges of the flat articles along a plurality of the sides of the base, thereby facilitating manual access to the articles and to permit selection and withdrawal of an uppermost article from the vending tray;

the restraining wall means, along one side of the support base, being formed to provide thereon a pair of oppositely facing, laterally spaced, upright clip segments that open in opposing lateral directions toward each other, the spacing of the clip segments and the shape thereof being such as to receive therein spaced edge portions of a flat article, whereby to hold one flat article transverse to the support base in an upright display position.

2. A vending and article display tray for flat articles, such as magazines, comprising, in combination:

means providing a substantially flat, polygonal, support base for receiving and supporting a plurality of flat articles stacked thereon;

a plurality of restraining wall means extending upwardly of the support base and adapted for general aligning cooperation with portions of the two lateral edges and the toe edges of the articles stacked on the base of the tray;

the tray having a head-end relative to the articles stored therein;

and upright restraining wall means at the head-end of the tray being cantilevered from said base and being formed to provide a pair of upright, laterally spaced, channel-like means that have open edges that open in opposing lateral directions toward each other above the base to provide a slot means for receiving thereinto opposite edges of a specimen of the flat articles, to hold said specimen upright as a sales display associated with the articles that lie stacked in the tray.

3. A construction as in claim 2 wherein the upright, laterally spaced, slot means includes a head-end wall extending upwardly from the base with spaced, oppositely facing, resilient clip portions formed integrally on the head-end wall and projecting toward each other to overlie said head-end wall; and said slot means being adapted and arranged to receive thereinto portions of opposite lateral edges of the upright specimen.

4. A construction as in claim 3 wherein the resilient clip portions each include a bight portion that extends transverse to the head-end wall, and a cantilevered resilient arm with one end thereof attached to the bight portion, and whose free end projects from said bight portion to a position spaced closer to the head-end wall.

5. A construction as in claim 2 wherein the support base has projecting therebelow, and transverse to the support base, a U-shaped support means which, when supported on a horizontal surface, causes the head-end of the tray to be slightly elevated with respect to the opposite, toe-end of the tray.

6. A construction as in claim 5 wherein the U-shaped support means is shaped to have portions thereof located adjacent but below the two lateral and toe-end restraining wall means that extend above the support base, to reinforce each of said restraining wall means.

7. A construction as in claim 6 wherein portions of the U-shaped support means adjacent the lateral restraining wall means each have a connection slot formed therethrough;

and a clip means with oppositely extending resilient portions thereon each adapted for releasable attachment to a connection slot, and adapted to be operatively associated with a pair of identical display trays for laterally ganging together said pair of display trays.

* * * * *